US006296212B1

(12) United States Patent
Monahan

(10) Patent No.: US 6,296,212 B1
(45) Date of Patent: Oct. 2, 2001

(54) BAG SUPPORT

(76) Inventor: Michael J. Monahan, 222 Maning St., Needham, MA (US) 02192

( * ) Notice: Subject to any disclaimer, the term of this patent is extended or adjusted under 35 U.S.C. 154(b) by 0 days.

(21) Appl. No.: 08/427,203

(22) Filed: Apr. 24, 1995

(51) Int. Cl.[7] ..... B65B 67/04
(52) U.S. Cl. ..... 248/99; 248/95
(58) Field of Search ..... 248/95, 99, 100, 248/101, 152

(56) References Cited

U.S. PATENT DOCUMENTS

| | | | | |
|---|---|---|---|---|
| 3,754,785 | * | 8/1973 | Anderson | 294/19 R |
| 3,936,087 | * | 2/1976 | Alexander | 248/99 |
| 4,291,798 | * | 9/1981 | Transport | 206/45.24 |
| 4,445,658 | * | 5/1984 | Ferron | 248/99 |
| 4,457,483 | * | 7/1984 | Gagné | 248/97 |
| 4,458,932 | * | 7/1984 | Resch | 294/1 B |
| 4,530,533 | * | 7/1985 | Dieter | 248/99 |
| 4,537,337 | * | 8/1985 | Girty | 223/114 |
| 4,537,376 | * | 8/1985 | Burku | 248/97 |
| 4,669,690 | * | 6/1987 | McEniry | 248/101 |
| 4,749,011 | * | 6/1988 | Rylander | 248/99 |
| 4,760,987 | * | 8/1988 | Cooke | 248/99 |
| 4,884,603 | * | 12/1989 | Simpson | 141/390 |
| 4,979,547 | * | 12/1990 | Hoerner | 248/95 |
| 5,065,965 | * | 11/1991 | Aulabaugh | 248/99 |
| 5,129,609 | * | 7/1992 | Tobin | 248/97 |
| 5,316,060 | * | 5/1994 | Hodgdon | 248/99 |

* cited by examiner

*Primary Examiner*—Leslie A. Braun
*Assistant Examiner*—Gwendolyn Baxter
(74) *Attorney, Agent, or Firm*—Pearson & Pearson, LLP

(57) ABSTRACT

A support device for holding a bag open, the support device having a straight free state flexible body with a width sufficient to extend along and hold open a majority of the length of a bag and also having a length which defines an arc when flexed inside a bag leaving one side of the bag unsupported by the flexible body for convenient raking and filling of the leaf bag.

5 Claims, 2 Drawing Sheets

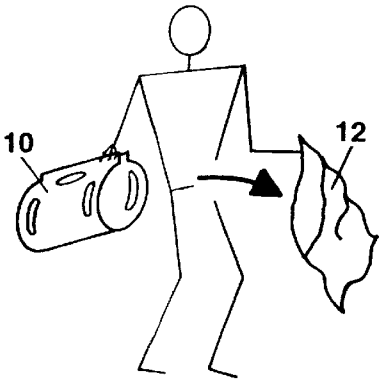
Figure 3A
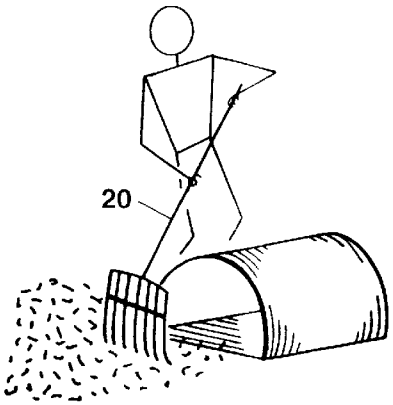
Figure 3B
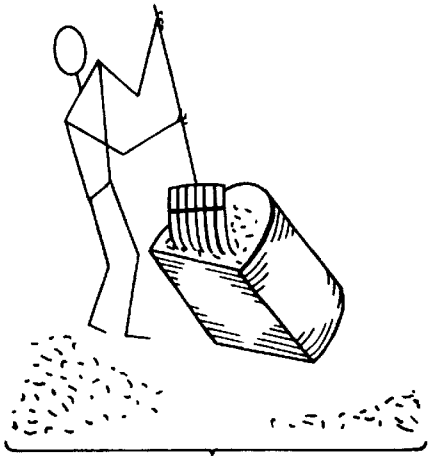
Figure 3C
Figure 3D
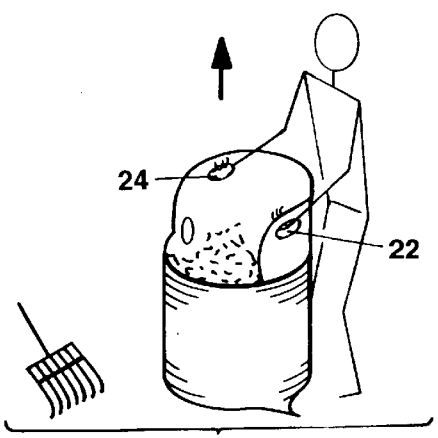
Figure 3E

BAG SUPPORT

FIELD OF INVENTION

This invention relates to a device for holding open and supporting a bag such as a leaf bag to make collection of leaves easier. Applicant has filed Disclosure Document No. 337318.

BACKGROUND OF INVENTION

Raking leaves has traditionally been a difficult spring and fall chore. The leaves can be blown or raked into adjacent woods or property in some rural areas, but in suburban areas this is not always possible or appropriate. One old method of handling a lot of leaves is to rake or blow them onto a sheet or tarpaulin and then haul them away. This works but generally requires more than one person and also a large vehicle.

Therefore, most people rake or blow the leaves in a pile and ultimately place the piles in individual bags or barrels for transport or pickup. The major problem with this is that typical lawn and leaf bags do not stay open without some additional support.

So, numerous devices have been developed to hold leaf bags open. The oldest method includes using a garbage can or barrel to support the bag from the outside. But, placing a bag inside a firm walled barrel or garbage can does not always work well: it is especially difficult to maintain the bag in the proper position during filling and it is also difficult to remove the bag from the container when it is full.

Other devices are designed to be placed inside the bag. Cooke, U.S. Pat. No. 4,760,982, for example, discloses three rigid panels hinged to form a trough to be placed inside the leaf bag. This device, however, has sharp edges and corners which tend to puncture or tear the leaf bags during insertion and removal. Also, the grip holes of this device are not placed appropriately for convenient handling. McEniry, U.S. Pat. No. 4,669,690, discloses a support structure for suspending an open bag from a wall. This device is simply not appropriate for yard work because it requires that the support structure be permanently attached to a wall-like structure. Corsaut, U.S. Pat. No. 4,664,348, discloses a trash bag holder which has a very narrow plastic strip with an intermediate straight portion adapted to engage either the ground or a wall hanging. See also U.S. Pat. Nos. 4,669,689; 3,754,785; 4,458,932; 4,537,337; 4,537,376; 4,445,658; 4,291,798; 4,457,483.

A product on the market under the trade name "CLEAN-UP CADDY" has a galvanized wire frame that holds only the mouth of the bag open so that it can be filled with leaves and garden waste. The primary problem with this device is that it can be difficult to install and, even when installed correctly, it holds only the mouth of the bag open making it difficult to fill the bag since the length of the bag is unsupported. Another product, sold under the trademark "EASY BAGGER", is a piece of plastic packaged and sold in a 4-inch diameter roll. This device is long enough so that it is intended to be used as an insert liner with all popular size trash, grass and leaf bags. If it worked as intended, this product would form a round container shape within and supporting the leaf bag. This product, however, is difficult to use for raking leaves: since it is round, there is no support surface and it cannot be easily used to rake leaves directly into the bag. Worse, because the product is packaged and sold in a four-inch diameter roll, by the time it is purchased and unpackaged, it has completely stress relaxed and stays in that small diameter roll form. The operating instructions say to "reverse roll" the product for use, but this is very difficult. When the product is inserted into a bag without reverse rolling, it returns to the very small diameter packaged shape. Even if the product is reverse rolled and inserted into a bag, it provides essentially no force against a leaf bag and the leaf bag will very quickly slide down the sides of the product.

SUMMARY OF INVENTION: I

It is therefore an object of this invention to provide an improved bag support for supporting and holding a bag open.

It is a further object of this invention to provide such a bag support which has a width sufficient to extend along and hold open a majority of the length of a bag.

It is a further object of this invention to provide such an improved bag support which has a length which, when flexed inside a bag, leaves one side of the bag unsupported thereby forming a flat, stable surface so that when the bag is laid on that flat side leaves or refuse can easily be raked directly into the bag.

It is a further object of this invention to provide such an improved bag support which automatically provides and maintains an opening in a leaf bag broad enough to facilitate a standard rake.

It is a further object of this invention to provide such an improved bag support which automatically maximizes the open volume of a standard leaf bag.

It is a further object of this invention to provide such an improved bag support which has rounded and smooth edges so that the leaf bag is not torn during insertion or removal.

It is a further object of this invention to provide such an improved bag support which more easily tips up when the bag is full and also remains stable in an upright position.

It is a further object of this invention to provide such an improved bag support which can be easily handled regardless of how it is inserted inside a leaf bag.

It is a further object of this invention to provide such an improved bag support which can be manufactured quickly and inexpensively.

This invention results from the realization that if, instead of attempting to support the opening of a leaf bag or even the entire leaf bag on the outside, and instead of attempting to support the entire circumference of a leaf bag from the inside, a leaf bag supported along a majority of its length only in an arc-like fashion, leaving one side of the bag unsupported, allows leaves to quite easily be raked into the bag over that flat unsupported side of the bag, and also that the flat unsupported side of the bag provides a stable platform which stabilizes the leaf bag in a horizontal position during raking.

This invention features a bag support and may, depending on the application, suitably comprise, include, consist essentially of and/or consist of a straight free state flexible body having a width sufficient to extend along and hold open a majority of the length of a bag and having a length which defines an arc when flexed inside a bag leaving one side of the bag unsupported by the flexible body.

The body typically has at least one hand-hold along the length thereof and may have a plurality of such hand-holds. The body typically has at least one hand-hold along the width as well. The bag support, to prevent tearing of the bag when used, preferably has radiused corners.

This invention also features a support device for holding a bag open, the support device comprising: a straight free state flexible body having a length which defines an arc, when flexed inside a bag leaving one side of the bag unsupported by the flexible body, the unsupported side thereby stabilizing the bag in position horizontally during raking.

DISCLOSURE OF PREFERRED EMBODIMENT

Other objects, features and advantages will occur to those skilled in the art from the following description of a preferred embodiment and the accompanying drawings, in which:

FIGS. 3A–3E are schematic depictions showing the use of the bag support of this invention.

Figure 1:
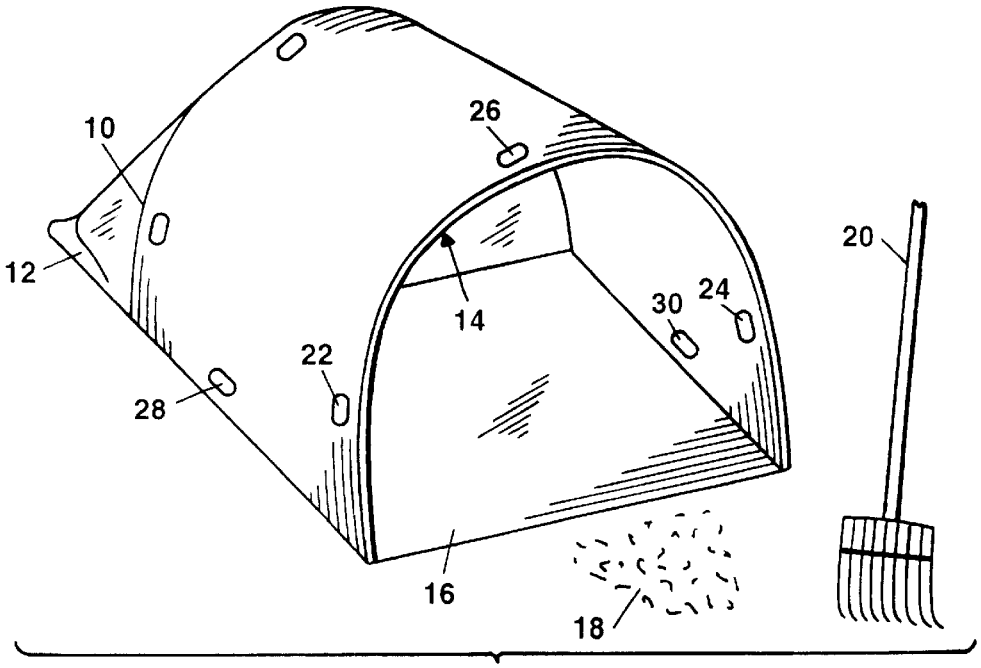
FIG. 1 is a schematic view of the bag support of this invention for holding a bag open shown in place within a standard 30 gallon leaf bag.

Bag support 10, FIG. 1, for holding a bag 12 open according to this invention has a sufficient width w to extend along and hold open a majority of the length of bag 12 as shown. Bag support 10 also has a sufficient length to define arc 14 when flexed inside of bag 12. The length of bag support 10, unlike prior designs, defines arc 14 but also leaves one side 16 of bag 12 unsupported.

This accomplishes two things. First, it provides a surface over which leaves 18 can be raked by rake 20 inside bag 12. Second, unsupported side 16 of bag 12 in combination with arc 14 provided by bag support 10 keeps bag 12 stable during raking operations. Products which have a round configuration are neither stable nor effective when the bag is placed in a horizontal position for raking.

Figure 2:
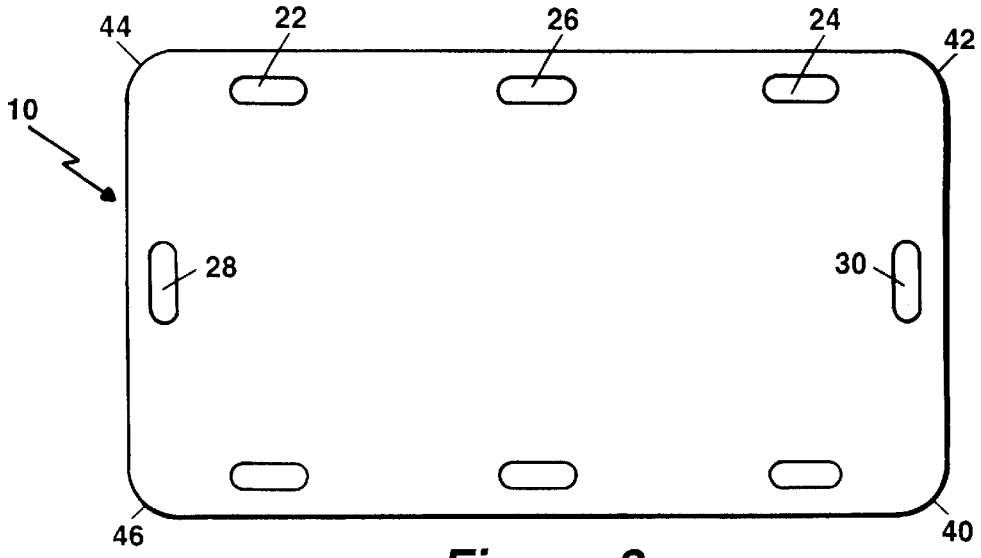
FIG. 2 is a top plan view of the bag support shown in FIG. 1.

As shown in FIGS. 1 and 2, there are a number of hand-holds 22, 24 and 26 along the length of each side of bag support 10 and also hand-holds 28 and 30 on either end.

Bag support 10 is preferably formed from 1/16 inch ABS extruded flat stock to provide a very flexible main body but also having enough rigidity when flexed to keep a leaf bag open during raking and to maintain arc 14 without the bag support 10 collapsing to either side. When not inserted inside of leaf bag 12, FIG. 1, bag support 10 has a natural tendency to lie flat, i.e., a straight free-state, FIG. 2. In this way, unlike prior devices, the bag support of this invention naturally stretches bag 12 firmly in an open position when inserted inside the bag. When bent to form arc 14, the stresses distributed throughout the flexed sheet inherently produce a near maximum volume of the bag.

As shown in FIG. 3A, the user temporarily flexes bag support 10 into a quasi circular shape and inserts it within leaf bag 12 where it unfurls and creates arc 14 and the flat side. The leaf bag is filled, FIG. 3B, and then bag support 10 maintains and supports bag 12 while the leaves are compacted, FIGS. 3C–3D. After the bag is filled, the bag support is removed, FIG. 3E, quite easily, using hand-holds 22 and 24.

Bag support 10 is preferably made from flat sheet stock available in various thicknesses and materials allowing design variations to be easily produced which have different properties. For example, flex strength can be varied and cardboard can be used for a disposable product. Also, flat sheet stock allows die cutting of all features, and die cutting has much lower tooling costs than injection molding. Bag support 10 of this invention, since it has a straight free state, is easily stored by hanging it from a hook or nail or by slipping it under or behind nearly anything.

In a preferred embodiment, the long side 1, FIG. 2, is approximately 43 inches, so that when installed in a standard 30 gallon (60 inch girth) lawn and leaf bag it produces a flat unsupported side which is stable when laid on that flat side. This particular length also allows insertion of a standard 16-inch rake. The short side width, w, is approximately 23.5 inches, so dimensioned that multiple copies can be die cut from standard 48 inch by 96 inch sheets with minimum waste. When installed in a standard 30 gallon (60 inch girth) lawn and leaf bag, it is wide enough to provide stability when laid on the flat side and it also extends along and holds open a majority of the length of the bag as shown in FIG. 1. Corners 40, 42, 44 and 46 are radiuses so that the bag support does not tear a leaf bag during insertion or removal and so the bag support more easily tips up and remains stable in the upright position shown in FIG. 3D.

Hand-holds 22, 24 and 26 are located proximate the edge of the main body of the bag support so that the bag support can easily be gripped. Hand-holds 28 and 30 are for holding bag support 10 in a flexed position so that it can be easily inserted inside a leaf bag; while hand-holds 22 and 24 (and also the opposing hand-holds) are for removing the bag support from the leaf bag after the leaf bag is filled as shown in FIG. 3E. Hand-hold 26 (and the opposing hand-hold) is for carrying the bag support with one hand and also for carrying the combination of the bag support and the leaf bag when the bag support is inserted inside the leaf bag. All edges, and especially the edges on the inside of each hand-hold 22, 24, 26, etc., are preferably rounded or beveled for comfort.

So designed, bag support 10 of this invention provides an improved supporting structure which also holds a leaf bag open for filling. It has a width sufficient to extend along and hold open a majority of the length of a leaf bag and has a length which, when flexed inside a bag, leaves one side of the bag unsupported thereby forming a flat, stable surface when the bag is laid on that flat side so that leaves can easily be raked directly into the bag. The bag support of this invention automatically provides and maintains an opening in a leaf bag broad enough to allow insertion of a sixteen-inch rake. The straight free-state feature of this invention automatically nearly maximizes the open volume of a standard leaf bag. Unlike prior devices, the bag support has rounded smooth edges and radiussed comers so that the bag support does not tear the plastic leaf bag during insertion or removal. The bag support of this invention more easily tips up due to the radiussed corners and remains stable in an upright position, can be easily handled regardless of how it is inserted inside a leaf bag, and can be manufactured quickly and inexpensively using die cutting methods instead of injection molding.

Although specific features of this invention are shown in some drawings and not others, this is for convenience only as each feature may be combined with any or all of the other features in accordance with the invention. For example, this invention is not limited to supporting only leaf bags. Other embodiments will occur to those skilled in the art and are within the following claims:

What is claimed is:

1. A support device comprising:

a straight free state, flexible body with opposing ends and opposing sides;

said flexible body having a predetermined length defining a half cylinder shape when flexed within a boundary having a predetermined circumference for said flexible body to adapt to said half cylinder shape, one opposing side of the flexible body being adapted to be coincident with an open end of the boundary, the other opposing side of the body being adapted to be coincident with a closed end of the boundary, the opposing ends of the flexible body being supported by the ground;

said half cylinder shape of said flexible body provides for said opposing ends of said flexible body to have a sufficient width therebetween to stabilize said flexible body.

2. The support device of claim 1 in which said body has at least one hand-hold along the length thereof.

3. The support device of claim 1 in which said body has a plurality of hand-holds along the length thereof.

4. The support device of claim 1 in which said body has at least one hand-hold along the width thereof.

5. A support device for holding a bag open, the bag having a predetermined circumference and length, comprising:

a straight free state, flexible body having a predetermined length;

a flexed state of said flexible body about an axis extending parallel to a short dimension of said body wherein upon insertion of said flexible body inside said bag, said flexible body unfurls to said half cylinder shape in accordance with the limitation of said predetermined circumference of said bag, said flexible body extending along a majority of said circumference of said bag for holding said bag open; and said flexible body in cooperation with said bag provides for the unsupported circumference of said bag to lie flat and stable on the ground as determined by an arc formed by said half cylinder shape of said flexible body.

* * * * *